US008104571B2

(12) United States Patent
Nakajima

(10) Patent No.: US 8,104,571 B2
(45) Date of Patent: Jan. 31, 2012

(54) EXTERNAL CYLINDER AND SILENCER PROVIDED WITH THE EXTERNAL CYLINDER

(75) Inventor: Shoichi Nakajima, Niiza (JP)

(73) Assignee: Honda Motor Co., Ltd., Tokyo (JP)

( * ) Notice: Subject to any disclaimer, the term of this patent is extended or adjusted under 35 U.S.C. 154(b) by 20 days.

(21) Appl. No.: 12/730,860

(22) Filed: Mar. 24, 2010

(65) Prior Publication Data

US 2011/0048849 A1 Mar. 3, 2011

(30) Foreign Application Priority Data

Aug. 28, 2009 (JP) ..... 2009-198675

(51) Int. Cl.

| | |
|---|---|
| ***F01N 1/10*** | (2006.01) |
| ***F01N 1/02*** | (2006.01) |
| ***F01N 13/18*** | (2006.01) |
| *F01N 1/00* | (2006.01) |
| *F01N 13/00* | (2006.01) |

(52) U.S. Cl. ..... 181/252; 181/243; 29/890.08

(58) Field of Classification Search ..... 181/252, 181/256, 243, 249, 282, 227, 228; 29/890.08
See application file for complete search history.

(56) References Cited

U.S. PATENT DOCUMENTS

| | | | | | |
|---|---|---|---|---|---|
| 3,507,357 | A * | 4/1970 | Blome | 181/282 |
| 4,239,091 | A * | 12/1980 | Negrao | 181/243 |
| 4,333,545 | A * | 6/1982 | Roberts | 181/282 |
| 4,576,247 | A * | 3/1986 | Thorpe | 181/243 |
| 4,854,417 | A * | 8/1989 | Uesugi et al. | 181/272 |
| 4,993,513 | A * | 2/1991 | Inoue et al. | 181/282 |
| 5,100,047 | A * | 3/1992 | Nakagawa et al. | 228/176 |
| 5,718,045 | A * | 2/1998 | Tsukahara et al. | 29/890.08 |
| 6,223,434 | B1 * | 5/2001 | Morikawa | 29/890.08 |
| 6,457,551 | B1 * | 10/2002 | Chang | 181/243 |
| 6,543,577 | B1 * | 4/2003 | Ferreira et al. | 181/282 |
| 7,434,656 | B2 * | 10/2008 | Yasuda et al. | 181/227 |
| 2010/0326961 | A1 * | 12/2010 | Nakajima | 219/66 |

FOREIGN PATENT DOCUMENTS

JP 2885348 B2 4/1999

* cited by examiner

*Primary Examiner* — Edgardo San Martin
(74) *Attorney, Agent, or Firm* — Westerman, Hattori, Daniels & Adrian, LLP

(57) ABSTRACT

A silencer capable of preventing a damage of a metallic layer formed on an inner surface of an external cylinder formed from CFRP, and the external cylinder for the silencer. The silencer 1 includes the external cylinder 2, an internal cylinder 3 and an acoustic absorbent (not shown). A posterior end **2*r* of the external cylinder 2 is detachably provided with a tail cap 4. An anterior end 2*f* of the external cylinder 2 is detachably provided with a coupling body 5. An inner circumferential surface of the posterior end 2*r* of the external cylinder 2 includes a posterior covering portion 30 while an inner circumferential surface of the anterior end 2*f* thereof includes an anterior covering portion 32. This posterior covering portion 30 covers a posterior end portion 8*r* of a metallic layer 8 while the anterior covering portion 32 covers an anterior end portion 8*f*** thereof.

4 Claims, 2 Drawing Sheets

EXTERNAL CYLINDER AND SILENCER PROVIDED WITH THE EXTERNAL CYLINDER

BACKGROUND OF THE INVENTION

1. Field of the Invention

The present invention relates to an external cylinder and a silencer provided with the external cylinder and specifically relates to a silencer whose external cylinder is formed from a resin material.

2. Description of the Related Art

Heretofore, a silencer is provided with an external cylinder, an internal cylinder arranged inside the external cylinder, and an acoustic absorbent filled between the internal cylinder and the external cylinder. Then, a cap with an exhaust port is detachably provided in one end of the silencer, while an exhaust pipe is allowed to detachably communicate with the other end thereof.

Further, a silencer whose external cylinder is formed from, e.g., carbon fiber reinforced plastics to reduce the weight is being used in auto racing or the like. An acoustic absorbent thus filled deteriorates and decreases with the use thereof and hence it is necessary that the cap and the exhaust pipe are detached to refill another acoustic absorbent therein as need arises.

However, there has been a problem that when a high-temperature exhaust gas contacts with an inner surface of the external cylinder formed from the carbon fiber reinforced plastics, the plastics spatters to damage the external cylinder. To solve this problem, a certain silencer is disclosed in e.g., Japanese patent publication No. 2885348, in which a metallic layer is provided on the inner surface of the external cylinder to prevent the exhaust gas from contacting with the inner surface, thereby restraining the damage of the external cylinder. Nevertheless, there still remains a problem that in refilling the acoustic absorbent, the cap and the exhaust pipe contact with the metallic layer formed on the inner surface of the external cylinder when detaching or attaching the cap and the exhaust pipe, and thus the metallic layer is damaged as it is exfoliated, for example.

SUMMARY OF THE INVENTION

In view of the problems described above, it is, therefore, an object of the present invention to provide an external cylinder capable of preventing the damage of a metallic layer formed on an inner surface of an external cylinder formed from a resin material such as carbon fiber reinforced plastics. It is another object of the present invention to provide a silencer including such external cylinder.

According to a first aspect of the present invention, there is provided an external cylinder used for a silencer having an internal cylinder acting as a primary passage of an exhaust gas, and an acoustic absorbent provided outside said internal cylinder, the external cylinder including:

a tubular body formed from a resin material;

a metallic layer provided on an inner surface of said tubular body;

an anterior covering portion provided on an inner circumferential surface of an anterior end of said external cylinder to cover an anterior portion of said metallic layer, and a posterior covering portion provided on an inner circumferential surface of a posterior end of said external cylinder to cover a posterior portion of said metallic layer.

According to a second aspect of the present invention, the anterior end of said metallic layer is formed so as to be located posterior to the anterior end of said external cylinder and anterior to a posterior end of a coupling body inserted into said anterior end of said external cylinder, while the posterior end of said metallic layer is formed so as to be located anterior to the posterior end of said external cylinder and posterior to an anterior end of a tail cap inserted into the posterior end of said external cylinder.

According to a third aspect of the present invention, there is provided a silencer which includes:

an external cylinder including a tubular body formed from a resin material and a metallic layer provided on an inner surface of said tubular body;

an internal cylinder arranged inside said external cylinder to act as a primary passage of an exhaust gas; and an acoustic absorbent provided between said external cylinder and said internal cylinder, wherein said external cylinder comprises:

an anterior covering portion provided on an inner circumferential surface of an anterior end of said external cylinder to cover an anterior portion of said metallic layer; and a posterior covering portion provided on an inner circumferential surface of a posterior end of said external cylinder to cover a posterior portion end of said metallic layer.

According to a fourth aspect of the present invention, the silencer is further provided with a coupling body detachably provided in the anterior end of the external cylinder and a tail cap detachably provided in the posterior end of the external cylinder. The anterior end of the metallic body is formed so as to be located posterior to the anterior end of the external cylinder and anterior to the posterior end of the coupling body inserted into the anterior end of the external cylinder, while the posterior end of the metallic body is formed so as to be located anterior to the posterior end of the external cylinder and posterior to the anterior end of the tail cap inserted into the posterior end of the external cylinder.

According to the first and third aspects of the present invention, the end of the metallic layer is covered with the anterior and posterior covering portions. Hence, the metallic layer formed in the inner surface of the external cylinder can be prevented from being damaged.

According to the second and fourth aspects of the present invention, the end portions of the metallic layer can be more reliably covered with the anterior and posterior covering portions.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Hereunder is a detailed description of a preferred embodiment of the present invention with reference to the accompanying drawings.

(1) Overall Structure

Figure 1:
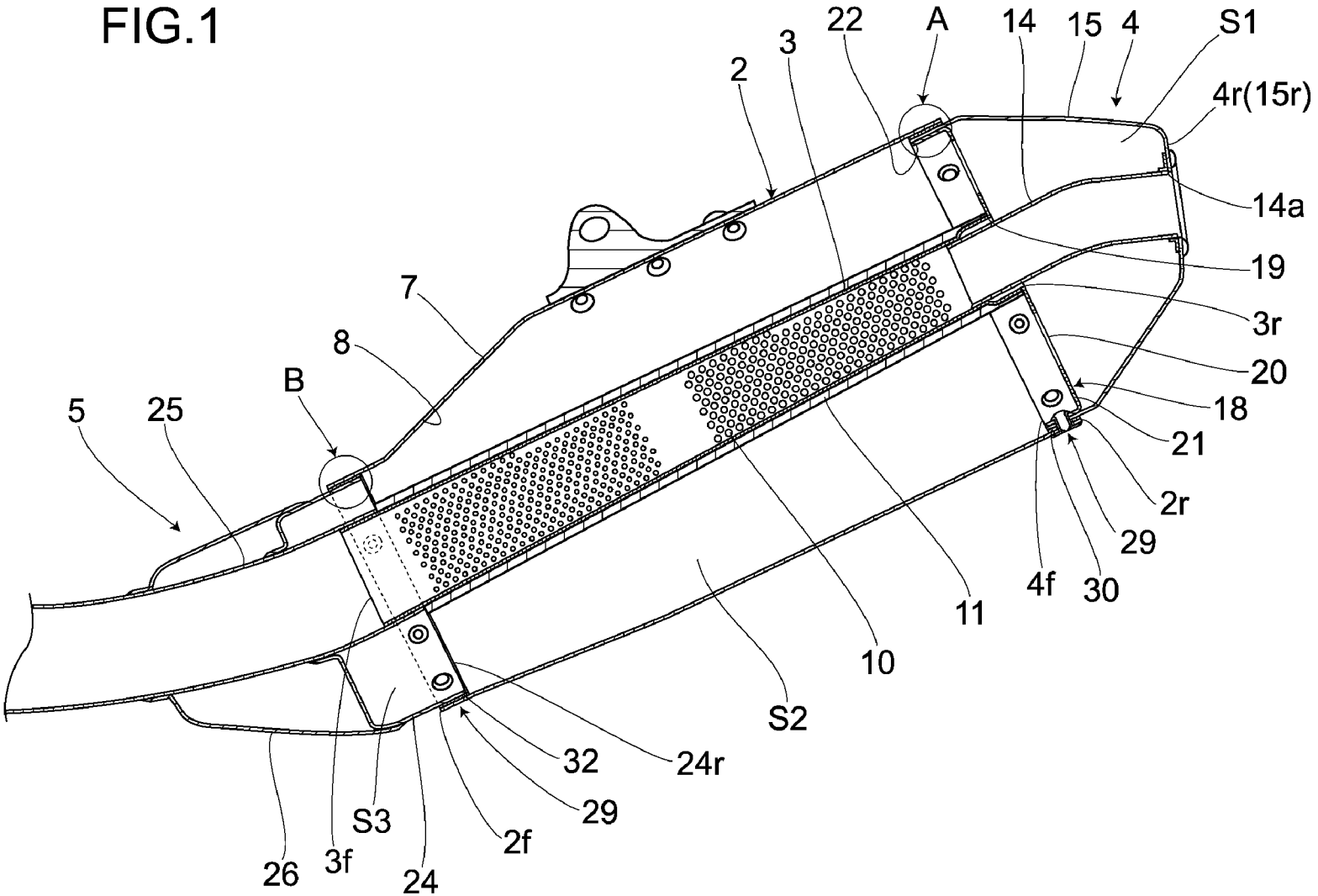
FIG. 1 is a longitudinal sectional view illustrating an overall structure of a silencer of the present invention.

A silencer 1 shown in FIG. 1 is provided with an external cylinder 2, an internal cylinder 3, and an acoustic absorbent (not shown). A posterior end 2*r* of the external cylinder 2 is detachably provided with a tail cap 4. An anterior end 2*f* of the external cylinder 2 is detachably provided with a coupling body 5. In the silencer 1, an exhaust gas discharged out of an engine (not shown) can be exhausted from the tail cap 4 to the outside via the internal cylinder 3. In the following description, a front of a vehicle (not shown) is referred to as "anterior" and a rear thereof is referred to as "posterior".

The external cylinder 2 includes a tubular body 7 formed from fiber reinforced plastics such as dry carbon and a metallic layer 8 formed on an inner surface of the tubular body 7. The metallic layer 8 may be formed of a thin film made of, e.g., iron, stainless steel, titanium, aluminum or the like. From a standpoint of a reduction in weight, however, it is desirable to form the metallic layer from an aluminum thin film.

The internal cylinder 3 is formed of a perforated metal with a plurality of punched holes 10 and is gradually reduced in diameter as coming closer from its anterior end 3*f* to its posterior end 3*r*. Stainless wool 11 is wound around an outer circumference of the internal cylinder 3, which is arranged substantially in the center inside the external cylinder 2.

The tail cap 4 includes an end pipe 14 communicating with the internal cylinder 3 and a cap unit 15 formed so as to surround the end pipe 14. In the tail cap 4, an opening end 14*a* of the end pipe 14 and a posterior end 15*r* of the cap unit 15 are welded together to integrate the end pipe 14 and the cap unit 15 with each other.

An anterior end 4*f* of the tail cap 4 is provided with an isolating body 18. The isolating body 18 is provided with a retention hole 19 formed substantially in the center thereof, a plate-shaped portion 21 including a plurality of openings 20 formed around the retention hole 19 and a strip-shaped portion 22 formed by erecting an outer edge of the plate-shaped portion 21 perpendicularly. In the isolating body 18, the strip-shaped portion 22 is arranged inside the anterior end 4*f* of the tail cap 4, while the posterior end 3*r* of the internal cylinder 3 is inserted into the retention hole 19.

The coupling body 5 includes a coupling portion 24 detachably coupled to the anterior end 2*f* of the external cylinder 2 and allows an exhaust pipe 25 to communicate with the silencer 1. The coupling portion 24 and the exhaust pipe 25 are coupled to each other by means of a cover 26. In addition, the exhaust pipe 25 is allowed to communicate with the anterior end 3*f* of the internal cylinder 3.

In the silencer 1 thus structured, an acoustic absorbent is filled in a first space S1 formed between an inside of the tail cap 4 and an outside of the end pipe 14, a second space S2 formed between an inside of the external cylinder 2 and an outside of the internal cylinder 3, and a third space S3 formed between an inside of the coupling pipe 24 and an outside of the exhaust pipe 25, respectively. As the acoustic absorbent, glass wool, for example, may be employed.

The tail cap 4 and the external cylinder 2, and the coupling body 5 and the external cylinder 2 are fixed by a fastening body 59 such as a blind rivet, respectively. In this case, the isolating body 18 is fixed integrally with the tail cap 4 and the external cylinder 2 in the strip-shaped portion 22.

Figure 2:
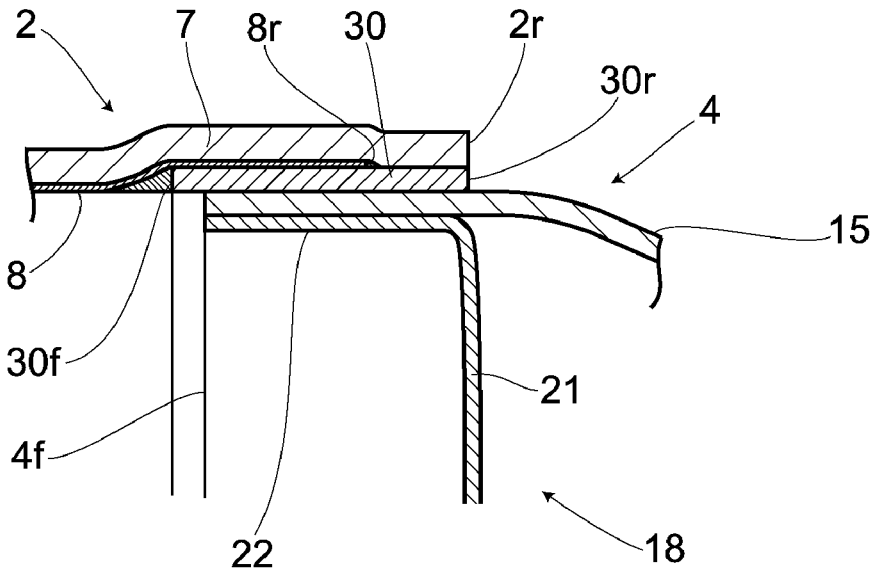
FIG. 2 is an enlarged sectional view of a part A in FIG. 1 illustrating a structure in the vicinity of a posterior covering portion.

In the tail cap 4 provided with the isolating body 18, its anterior end 4*f* is, as shown in FIG. 2, inserted into an inside of the posterior end 2*r* of the external cylinder 2 to be detachably coupled thereto. The external cylinder 2 has an inner circumferential surface of the posterior end 2*r* thereof provided with a posterior covering portion 30. The posterior covering portion 30 is formed from fiber reinforced plastics, e.g., a material impregnated with glass fiber and is made up of a strip-shaped annular body. This posterior covering portion 30 covers a posterior end portion 8*r* of the metallic layer 8.

Further, the posterior end portion 8*r* of the metallic layer 8 is formed so as to be located anterior to the posterior end 2*r* of the external cylinder 2 and posterior to the anterior end 4*f* of the tail cap 4 inserted thereinto. A portion between the posterior end portion 8*r* of the metallic layer 8 and the posterior end 2*r* of the external cylinder 2 acts as a bonding plane of the external cylinder 2 and the posterior covering portion 30 to prevent the damage caused by a sliding action described later.

Further, the posterior covering portion 30 is formed so that its posterior end 30*r* may be flush with the posterior end 2*r* of the external cylinder 2, and besides its anterior end 30*f* may be located anterior to the anterior end 4*f* of the tail cap 4 inserted into the posterior end 2*r* of the external cylinder 2.

Figure 3:
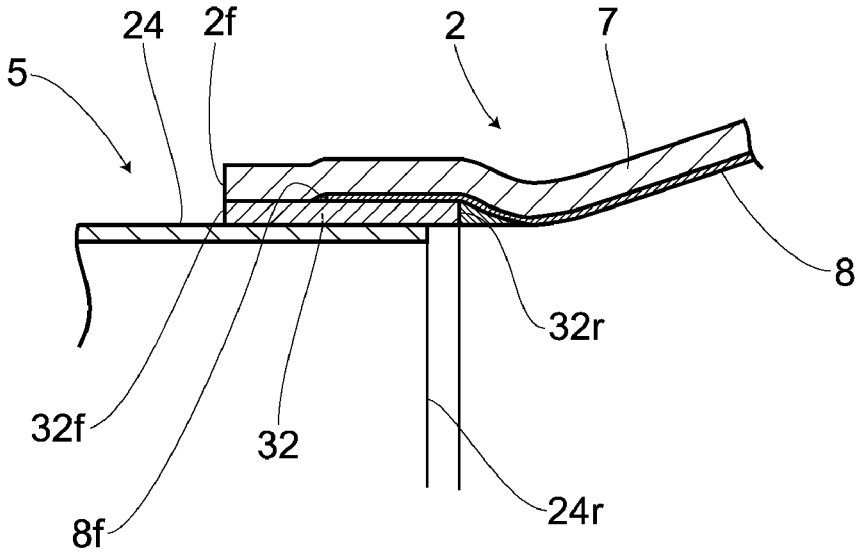
FIG. 3 is an enlarged sectional view of a part B in FIG. 1 illustrating a structure in the vicinity of an anterior covering portion.

Similarly, the coupling body 5 has the posterior end 24*r* of the coupling portion 24 thereof, as shown in FIG. 3, inserted into an inside of the anterior end 2*f* of the external cylinder 2 to be detachably coupled thereto. An inner circumferential surface of the anterior end 2*f* of the external cylinder 2 is provided with an anterior covering portion 32. As is the case with the posterior covering portion 30, the anterior covering portion 32 is formed from fiber reinforced plastic, e.g., a material impregnated with glass fiber and is made up of a strip-shaped annular body. This anterior covering portion 32 covers the anterior end portion 8*f* of the metallic layer 8.

Further, the anterior end portion 8*f* of the metallic layer 8 is formed so as to be located posterior to the anterior end 2*f* of the external cylinder 2 and anterior to the posterior end 24*r* of the coupling portion 24 inserted into the anterior end 2*f* of the external cylinder 2. Furthermore, an anterior end 32*f* of the anterior covering portion 32 and the anterior end 2*f* of the external cylinder 2 are allowed to be flush with each other, and besides a posterior end 32*r* of the anterior covering portion 32 is formed so as to be located posterior to the posterior end 24*r* of the coupling portion 24 inserted into the anterior end 2*f* of the external cylinder 2.

Next is a description of a method for manufacturing the silencer 1 thus structured. First, a method for manufacturing the external cylinder 2 is described. Strip-shaped members to be each formed into the posterior covering portion 30 and the anterior covering portion 32 are wound around a longitudinal end of a rod-like cored bar not shown. Then, the metallic layer 8 and a plate made of dry carbon which is to be formed into the tubular body 7 are sequentially wound around the longitudinal end. A longitudinal length of the metallic layer 8 is formed shorter than that of the external cylinder 2, allowing a longitudinal end of the metallic layer 8 to be arranged inside a longitudinal end of the external cylinder 2.

Then, each of the above members is heated with the members wound around the cored bar to integrate the tubular body 7, the metallic layer 8, the posterior covering portion 30 and the anterior covering portion 32, together. After being hardened, a through-hole (not shown) for inserting the fastening body 29 thereinto is formed in both the longitudinal ends, thus obtaining the external cylinder 2.

The internal cylinder 3 around which the stainless wool and the acoustic absorbent are sequentially wound in advance is inserted into the above-structured external cylinder 2. The internal cylinder 3 is arranged substantially in the center of the inside of the external cylinder 2. Further, the tail cap 4 and the coupling body 5 are each filled with the acoustic absorbent.

Then, the anterior end 4*f* of the tail cap 4 is inserted into the inside of the posterior end 2*r* of the external cylinder 2 with the isolating body 18 attached to the anterior end 4*f*. In this case, in order to prevent an exhaust gas from leaking from where the tail cap 4 is coupled to the external cylinder 2, a fitting tolerance between the external cylinder 2 and the tail cap 4 is desirably smaller. Accordingly, when the tail cap 4 is inserted into the posterior end 2*r* of the external cylinder 2, an outer circumferential surface of the tail cap 4 and the inner circumferential surface of the external cylinder 2 are allowed to slide on each other.

The tail cap 4 and the strip-shaped portion 22 are formed with insertion holes (not shown) in positions corresponding to the through-hole formed in the posterior end 2*r* of the external cylinder 2. The fastening body 29 is inserted into the through-hole and the insertion holes to properly position the external cylinder 2, the tail cap 4 and strip-shaped portion 22.

In the same way, the coupling portion 24 of the coupling body 5 is inserted into the inside of the anterior end 2*f* of the external cylinder 2. The coupling portion 24 is formed with an insertion hole (not shown) in a position corresponding to the through-hole formed on the anterior end 2*f* of the external cylinder 2. Then, the fastening body 29 is inserted into the through-hole and the insertion hole to properly position the external cylinder 2 and the coupling body 5.

By fixing the fastening body 29 under such conditions, the external cylinder 2, the tail cap 4 and the coupling body 5 are integrated together, thus obtaining the silencer 1.

(2) Working and Effect

The silencer 1 thus structured is mounted on a two-wheeled motor vehicle with the exhaust pipe 25 allowed to communicate with an engine (not shown). An exhaust gas sent out of the engine enters the silencer 1 through the exhaust pipe 25. In the silencer 1, the exhaust gas enters into the second space from the internal cylinder 3 via the punched holes 10 of the internal cylinder 3, so that it expands.

As a result, noise energy of the exhaust gas is absorbed by the acoustic absorbent to be discharged from an end pipe 14 to the outside. In this way, the silencer 1 muffles the noise caused by the exhaust gas, discharging the exhaust gas outward.

Incidentally, the acoustic absorbent deteriorates through an absorbing action of the noise energy of the exhaust gas to thereby reduce in volume. Therefore, the acoustic absorbent becomes unable to efficiently absorb the noise energy and hence the acoustic absorbent needs to be accordingly refilled.

In order to refill the acoustic absorbent, the fastening body 29 is first broken by using a drill or the like to detach the tail cap 4 and the coupling body 5 from the external cylinder 2, and an acoustic absorbent which has got ineffective is taken out from the external cylinder 2, the tail cap 4 and the coupling body 5. Then, a new acoustic absorbent is refilled in the external cylinder 2, the tail cap 4 and the coupling body 5, respectively. After that, as described above, the tail cap 4 and the coupling body 5 are again fixed to the external cylinder 2.

Here, the inner circumferential surface of the posterior end 2*r* of the external cylinder 2 is provided with the posterior covering portion 30. As a result, the tail cap 4 is inserted into the external cylinder 2 with the anterior end 4*f* thereof sliding on the surface of the posterior covering portion 30. According to the silencer 1 of the invention, therefore, the anterior end 4*f* of the tail cap 4 is inserted into the external cylinder 2 without the tail cap 4 coming in contact with the metallic layer 8 formed on the inner surface of the external cylinder 2. Hence, the posterior end portion 8*r* of the metallic layer 8 can be prevented from being damaged.

In a similar fashion, the inner circumferential surface of the anterior end 2*f* of the external cylinder 2 is provided with the anterior covering portion 32. As a result, the coupling body 5 is inserted into the external cylinder 2 with the coupling portion 24 sliding on a surface of the anterior covering portion 32. According to the silencer 1 of the present invention, therefore, the coupling portion 24 is inserted into the external cylinder 2 without the coupling portion 24 coming in contact with the metallic layer 8 formed on the inner surface of the external cylinder 2. Hence, the anterior end portion 8*f* of the metallic layer 8 can be prevented from being damaged.

According to the silencer 1 of the present invention, the tail cap 4 and the coupling body 5 can be fitted without damaging the metallic layer 8 formed on the inner surface of the external cylinder 2. Hence, the refilling work of the acoustic absorbent can be efficiently implemented.

Further, according to the silencer 1, there are provided the anterior and posterior covering portions 30, 32 and thus the damages of the metallic layer 8 such as the exfoliation, breaking or the like thereof can be prevented in forming the through-hole. Hence, production of defective units can be prevented and besides assembling workability can be improved.

Furthermore, according to the silencer 1, the tail cap 4 and the coupling body 5 can be fitted without damaging the metallic layer 8 and therefore fitting tolerances between the external cylinder 2, and the tail cap 4 and the coupling body 5 can be reduced. Consequently, according to the silencer 1, the exhaust gas leakage from the juncture of the tail cap 4 and coupling body 5 relative to the external cylinder 2 can be curbed and besides the amount of the acoustic absorbent provided to seal the junctures can be reduced.

Further, the anterior end 30*f* of the posterior covering portion 30 is formed so as to be located anterior to the anterior end 4*f* of the tail cap 4 inserted into the posterior end 2*r* of the external cylinder 2. As a result, according to the silencer 1, the posterior covering portion 30 is formed longer than a sliding range of the anterior end 4*f* of the tail cap 4, thereby ensuring the metallic layer 8 to be more reliably prevented from being damaged.

Likewise, the posterior end 32*r* of the anterior covering portion 32 is formed so as to be located posterior to the posterior end 24*r* of the coupling portion 24 inserted into the anterior end 2*f* of the external cylinder 2. As a result, according to the silencer 1, the anterior covering portion 32 is formed longer than a sliding range of the posterior end 24*r* of the coupling portion 24, thereby permitting the metallic layer 8 to be more reliably prevented from being damaged.

The present invention is not limited to the foregoing embodiment and various modifications are accordingly possible within the scope of the gist of the present invention. Whilst the silencer in the foregoing embodiment is described such that the posterior covering portion 30 and the anterior covering portion 32 are formed integrally with the tubular body 7, the present invention is not limited to this structure. For example, after having formed the tubular body 7 and the metallic layer 8 integrally with each other, the posterior covering portion 30 and the anterior covering portion 32 may be formed integrally therewith by using adhesion bond or the like.

Further, although the blind rivet is used as the fastening body 29 in the foregoing embodiment, it may be replaced by a set of bolt and nut. In this case, the nut may be fixed to the inside of the strip-shaped portion 22 of the isolating body 18 and that of the coupling portion 24. Also, the resin material should not be limited to carbon fiber reinforced plastics, but may be any other suitable resin material such as Kevlar®.

What is claimed is:

1. An external cylinder used for a silencer, having an internal cylinder acting as a primary passage of an exhaust gas, and an acoustic absorbent provided outside said internal cylinder, said external cylinder comprising:

a tubular body formed from a resin material;

a metallic layer provided on an inner surface of said tubular body;

an anterior covering portion provided on an inner circumferential surface of an anterior end of said external cylinder to cover an anterior portion of said metallic layer; and a posterior covering portion provided on an inner circumferential surface of a posterior end of said external cylinder to cover a posterior portion of said metallic layer, wherein an anterior end of said metallic layer is formed so as to be located posterior to the anterior end of said external cylinder and anterior to a posterior end of a coupling body inserted into the anterior end of said external cylinder, while a posterior end of said metallic layer is formed so as to be located anterior to the posterior end of said external cylinder and posterior to an anterior end of a tail cap inserted into the posterior end of said external cylinder.

2. A silencer comprising:

an external cylinder including a tubular body formed from a resin material and a metallic layer provided on an inner surface of said tubular body;

an internal cylinder arranged inside said external cylinder to act as a primary passage of an exhaust gas;

an acoustic absorbent provided between said external cylinder and said internal cylinder;

a coupling body detachably provided in an anterior end of said external cylinder; and a tail cap detachably provided in a posterior end of said external cylinder, wherein said external cylinder comprises:

an anterior covering portion provided on an inner circumferential surface of an anterior end of said external cylinder to cover the anterior portion of said metallic layer; and a posterior covering portion provided on an inner circumferential surface of the posterior end of said external cylinder to cover a posterior portion end of said metallic layer, and wherein an anterior end of said metallic layer is formed so as to be located posterior to the anterior end of said external cylinder and anterior to a posterior end of said coupling body inserted into the anterior end of said external cylinder, while a posterior end of said metallic layer is formed so as to be located anterior to the posterior end of said external cylinder and posterior to an anterior end of said tail cap inserted into the posterior end of said external cylinder.

3. The silencer according to claim 2, wherein the posterior end of said posterior covering portion and the posterior end of said external cylinder are formed flush with each other.

4. The silencer according to claim 2, wherein the anterior end of said anterior covering portion and the anterior end of said external cylinder are formed flush with each other.

* * * * *